US005950844A

United States Patent [19]

Taylor

[11] Patent Number: 5,950,844

[45] Date of Patent: Sep. 14, 1999

[54] SUPPORT APPARATUS

[76] Inventor: Maximillian F. Taylor, 320 Lake Merced Blvd., Apt. #16, Daly City, Calif. 94015

[21] Appl. No.: 08/999,016

[22] Filed: Dec. 29, 1997

[51] Int. Cl.[6] ..... A47F 7/00

[52] U.S. Cl. ..... 211/85.7; D6/552; 211/70.5; 211/118; 211/89.01

[58] Field of Search ..... D6/552; 211/85.7, 211/70.5, 64, 60.1, 113, 117, 118, 87.01, 89.01, 103

[56] References Cited

U.S. PATENT DOCUMENTS

| | | | |
|---|---|---|---|
| D. 343,750 | 2/1994 | Wolf . | |
| D. 365,236 | 12/1995 | Stockwell | D6/552 |
| 1,014,004 | 1/1912 | Irwin . | |
| 1,853,261 | 4/1932 | Dawson . | |
| 2,457,195 | 12/1948 | Bagnall . | |
| 3,063,570 | 11/1962 | Kvoner | 211/113 |
| 3,901,165 | 8/1975 | Schlesinger | 211/113 X |
| 4,195,739 | 4/1980 | Sweet, III . | |
| 5,027,960 | 7/1991 | Rainville . | |
| 5,107,995 | 4/1992 | Simpson | 211/60.1 |
| 5,542,530 | 8/1996 | Freelander | 211/118 X |

*Primary Examiner*—Robert W. Gibson, Jr.
*Attorney, Agent, or Firm*—Worrel & Worrel

[57] ABSTRACT

An apparatus for supporting a work object having a pair of deformable elongated members, a mount adapted to support the deformable elongated members in substantially side-by-side relation, and a securing member mounted on the deformable elongated members in spaced relation to the mount and movable therealong so as releasably to capture a work object between the deformable elongated members, the mount and the securing member.

8 Claims, 2 Drawing Sheets

SUPPORT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a support apparatus and, more particularly, to such a support apparatus which is particularly well suited to the support and storage of a plurality of individual items in an efficient and readily accessible manner.

2. Description of the Prior Art

The accumulation of possessions is seemingly inherent in life. However, this affinity for personal possessions plagues our daily lives where adequate means are not available for the management thereof. A host of devices are available for this general purpose including a multiplicity of types of containers, storage cabinets, racks, stands, and other storage facilities. Such prior art devices can be characterized by the fact that they are designed to receive and store possessions of the same type having the same general characteristics such as, for example, size, shape, weight, structure and the like. Such prior art devices may generally be suitable for relatively small, uniform and otherwise ordered possessions, but are entirely unsuited to items of a larger and less uniform nature.

For example, many possessions, particularly those employed in various sports activities, are both large and of irregular configurations making such storage and management using conventional devices inadequate or otherwise unsatisfactory. It has long been recognized that such possessions can, as a practical matter, be stored adjacent to living areas only if they are frequently used. Otherwise, these items must be stored in much less accessible areas where adequate storage space is available their presence does not interfere with other activities. Thus, the choice is often between accessibility for frequent use, or inaccessibility for protection and safety. Neither of these options is entirely satisfactory.

Other problems incident to the use and storage of relatively large and irregularly shaped and sized possessions include the difficulties associated with the maintenance thereof. Where such items are left out, they are typically more susceptible to damage, deterioration, loss, theft and the like. However, where such items are left in storage, it may be difficult or inconvenient to monitor their conditions over a prolonged period of time which may similarly lead to one or more of these same difficulties.

Therefore, it has long been known that it would be desirable to have a support apparatus capable of storing a wide variety of different work objects of different sizes, shapes, weights and the like; which possesses the capability of adjusting to the characteristics of the particular work objects involved; which support such work objects in a manner which makes them readily accessible for use while protecting them in a manner most conducive to prolonged useable lives; which permits such work objects to be stored in proximity to areas readily accessible for use while being fully concealed and protected as desired; which facilitates the ease with which the work objects can be inventoried; which permits such items readily to be monitored for the maintenance thereof; which is of inexpensive construction and possesses an ease of operation permitting usage by virtually anyone desiring such a capability; and which is otherwise fully successful in achieving its operational objectives.

BRIEF SUMMARY OF THE INVENTION

Therefore, it is an object of the present invention to provide an improved support apparatus operable to both support and store a wide variety of different types of work objects.

Another object is to provide such a support apparatus which is capable of automatically adjusting to the individual characteristics of a wide variety of different types of work objects and particularly those which are relatively large in size and of irregular configurations.

Another object is to provide such a support apparatus which operates to permit a wide variety of personal possessions to be stored in adjacent areas for frequent use while being protected from such hazards as damage, deterioration, loss, theft and the like.

Another object is to provide such a support apparatus which inherently operates to provide, in effect, an inventory of such work objects accessible on observation thereof.

Another object is to provide such a support apparatus which permits the observation of such possessions so as to permit them to be maintained in the best possible conditions.

Another object is to provide such a support apparatus which is quite inexpensive to manufacture and install so as to permit use by virtually all persons having the need therefor.

Another object is to provide such a support apparatus which is uniquely well suited to the support and storage of sporting equipment such as surf boards, skim boards, wake boards, snow boards, water skis, snow skis and poles, baseball bats and a wide variety of other types of possessions and particularly sporting equipment.

Further objects and advantages are to provide improved elements and arrangements thereof in an apparatus for the purpose described which is dependable, economical, durable and fullly effective in accomplishing its intended purposes.

These and other objects and advantages are achieved, in the preferred embodiment of the present invention, in an apparatus for supporting a work object having a pair of deformable members, an assembly mounting the pair of deformable members in substantially side-by-side relation, and a securing member adapted to engage the pair of deformable members in spaced relation to the mounting means so as to capture a work object between the deformable members of the pair of deformable members.

DETAILED DESCRIPTION OF THE INVENTION

Figure 1:
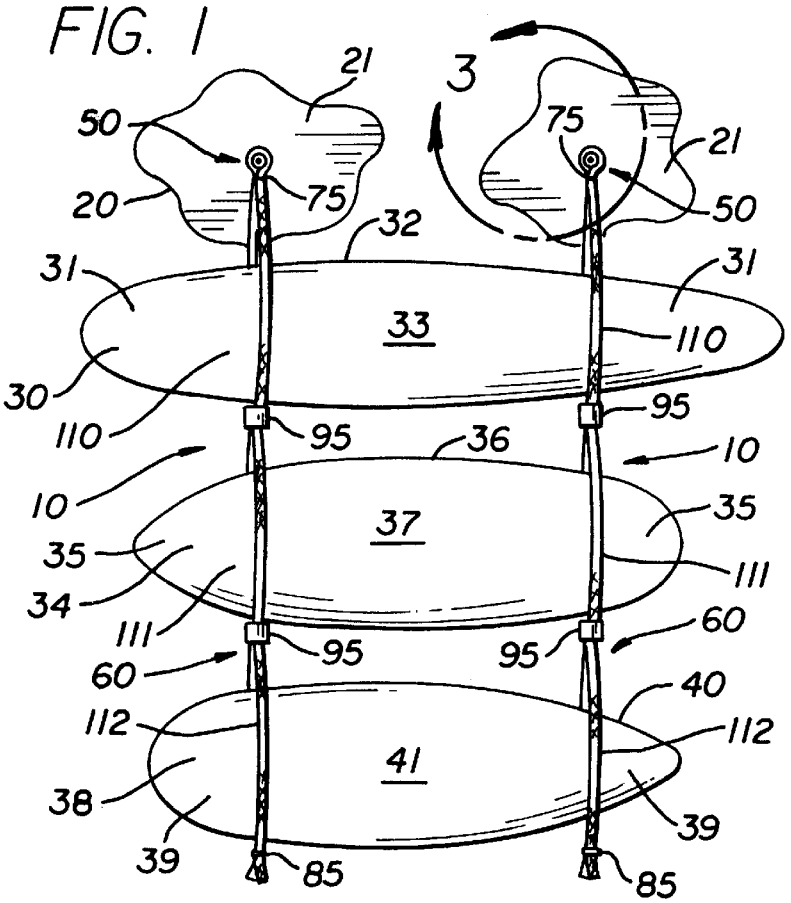
FIG. 1 is a fragmentary front elevation of the support apparatus of the present invention employed in a typical operative environment wherein a pair of support apparatuses of the present invention are employed in supporting and storing three different types of work objects in suspended relation on a wall surface.

Referring more particularly to the drawings, the support apparatus of the present invention is generally indicated by the numeral 10 in FIG. 1. The support apparatus can be employed in a wide variety of operative embodiments and, similarly, possesses a virtually unlimited number of environments within which it can be used.

In the illustrative operative environment, shown in the drawings and described herein, two of the support apparatuses 10 are mounted in depending relation on an upright structure, or wall, 20 having a vertical surface 21. For purposes of visualizing the specific environment of use, the wall 20 can be visualized as being the wall of a room, such as within a house, dormitory, apartment or the like.

As shown in FIG. 1, and as hereinafter described in greater detail, the two support apparatuses 10 are supporting and storing a first work object, or long board, 30, having opposite end portions 31 and bounded by a peripheral edge 32. The long board, thus, has opposite sides, or faces, 33 and is of a substantially flat configuration characteristic of surf boards.

A second work object, or surf board, is generally indicated by the numeral 34 in FIG. 1. The surf board 34 has opposite end portions 35 and is bounded by a peripheral edge 36. The surf board 34 has opposite sides, or faces, 37 and is similarly of a substantially flat configuration.

A third work object, or surf board, is generally indicated by the numeral 38 in FIG. 1. The surf board 38 has opposite end portions 39 and is bounded by a peripheral edge 40. The surf board is, again, of a substantially flat configuration and has opposite sides, or faces, 41.

Figure 3:
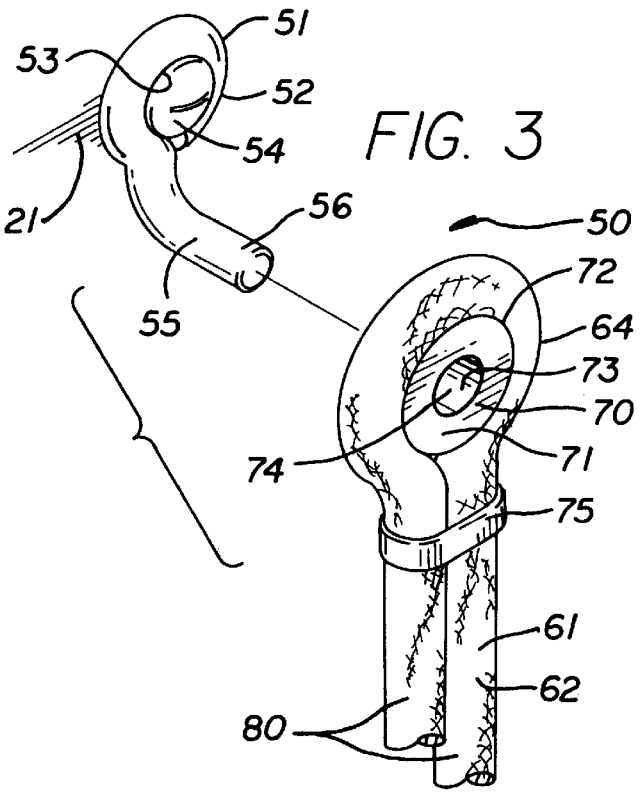
FIG. 3 is a somewhat further enlarged, fragmentary perspective view of the upper portion of the support apparatus of the present invention.

The support apparatus 10 has a mounting assembly generally indicated by the numeral 50 and shown best in FIG. 3. The mounting assembly has a support member 51 of metal construction and has an annular portion 52 defining a hole 53. A screw assembly 54 is employed to mount the support member 51 on the wall 20 in facing engagement with the surface 21 thereof in the desired position, as will hereinafter be described in greater detail. The support member 51 has a pin or shaft portion 55 extending outwardly from the surface 21 of the wall 20 in substantially right angular relation thereto and extends to a distal end portion 56.

Figure 2:
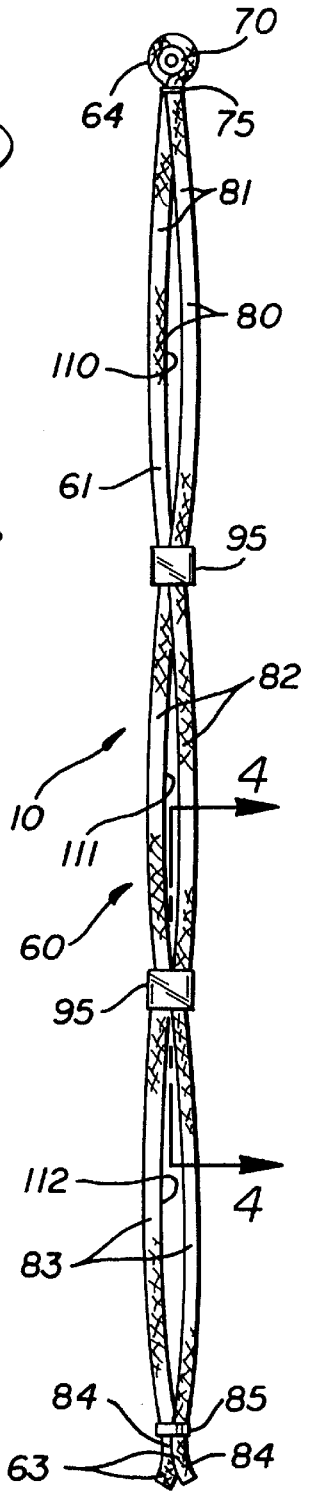
FIG. 2 is a somewhat enlarged, front elevation of one of the support apparatuses of the present invention.

The support apparatus 10 further includes a resilient support assembly generally indicated by the numeral 60 and, perhaps, best shown in FIG. 2. As previously discussed, the support apparatus of the present invention can be constructed in a wide variety of specific operative embodiments. The embodiment shown and described herein is merely one such embodiment, but possesses a number of operative advantages, as will hereinafter become more clearly apparent. In the preferred embodiment, the resilient support assembly is constructed from an elastic cord 61. While a variety of types of elastic cords can be employed for this purpose, in the preferred embodiment, the elastic cord is, more specifically, a bungee cord consisting of a multiplicity of individual elastic strands running longitudinally thereof and captured, or housed, in a woven synthetic outer jacket or wall. Thus, the elastic cord 61 has a woven outer surface 62 of a substantially cylindrical configuration. The elastic cord has opposite end portions 63 and an intermediate portion 64.

The resilient support assembly 60 further includes a mounting ring 70, preferably, although not necessarily, constructed of metal. The mounting ring has opposite front and rear side surfaces 71 and a concave peripheral surface 72 forming an annulus about the mounting ring. The mounting ring has an interior cylindrical surface 63 defining a hole 74 dimensioned slidably to be received on the shaft portion 55 of the support member 51. As shown in FIGS. 2 and 3, the intermediate portion 64 of the elastic cord 61 is extended about the mounting ring 70 and fitted within the concave peripheral surface 72 thereof. A metal band 75 is affixed about the elastic cord, as shown in FIG. 3, to mount the mounting ring within the intermediate portion of the elastic cord, as shown in FIG. 3. The mounting ring is, thus, securely mounted in position and forms a unitary entity with the elastic cord 61.

A pair of deformable, or elastic, linear members 80 is thereby formed from the elastic cord 61. The elastic linear members have upper end portions 81, central portions 82 and lower end portions 83. The lower end portions 83 extend to distal end portions 84. The distal end portions 84 of the elastic linear members are bound together by a metal band 85. Thus, the elastic linear members are securely fastened to each other at the opposite ends of the resilient support assembly 60, as best shown in FIG. 2.

A plurality of securing members are received about and thereby mounted on the pair of elastic linear members 80, as shown in FIGS. 1 and 2. Each of the securing members has an interior metal sleeve 96 having an outer cylindrical surface 97 and an interior cylindrical surface 98. The interior cylindrical surface bounds an interior passage 99 of predetermined diameter. The interior passage extends through the opposite ends of the metal sleeve through a beveled upper annulus 100 and an opposite beveled lower annulus 101. The metal sleeve is preferably encapsulated in an outer clear vinyl tube 102.

As shown in FIG. 2, the resilient support assembly 60 can be visualized as having an upper storage area 110 bounded by the metal band 75, the pair of elastic linear members 80 immediately therebeneath and the securing member 95 nearest the metal band 75. Similarly, the support assembly 60 can be visualized as having a central storage area 111 bounded by the securing members 95 at opposite ends thereof and the pair of elastic linear members 80. The support assembly 60 can be visualized as having a lower storage area 112 bounded by the lowermost securing member 95, the metal band 85 and the pair of elastic linear members 80.

Figure 4:
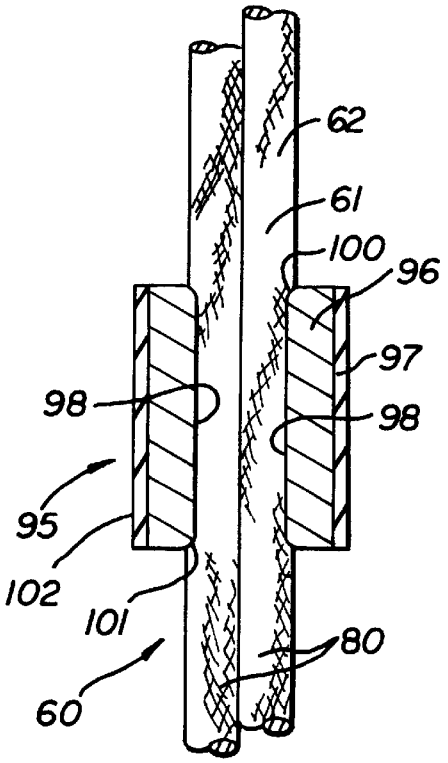
FIG. 4 is a longitudinal, vertical section taken on line 4—4 in FIG. 2.

As will hereinafter be described in greater detail, the operation of the support apparatus 10 is depicted, in part, in FIGS. 4 and 5 and, for this purpose, a pair of human hands are indicated by the numeral 120.

OPERATION

The operation of the described embodiment of the subject invention is believed to be clearly apparent and is briefly summarized at this point.

As previously noted, the support apparatus 10 can be employed in a wide variety of embodiments and environments of use. In the illustrative environment depicted in FIG. 1, a pair of the support apparatuses 10 are mounted in laterally spaced relation to each other on their respective mounting assemblies 50 in supported relation on the vertical surface 21 of wall 20. Each of the resilient support assemblies 60 is slidably received, through the medium of its respective mounting ring 70, about the shaft portion 55 of the support member 51. Each resilient support assembly 60 is, thus, gravitationally suspended from its respective support member 51 in juxtaposition to the vertical surface 21 of the wall 20.

The length of each resilient support assembly 60 can be of any suitable measurement and is controlled, in part, by the number and size of the work objects to be supported and stored thereon. For illustrative convenience, the support apparatus 10 depicted in the drawings hereof, is of the length sufficient to support the long board 30, surf board 34 and surf board 38. The particular height on the wall 20 at which the support apparatuses are mounted is purely dependent upon the preferences of the user. Thus, the support apparatuses can be positioned in side-by-side relation so that the distal end portions 84 thereof are immediately above the floor surface, not shown, in the room in which they are employed. Alternatively, the support apparatuses can be mounted in a much more elevated position so that the distal end portions 84 are well above the floor surface. For example, they can be mounted at an elevation such that the work objects borne thereby are, for example, visible, but not accessible without the use of a ladder or other means of support. Thus, for example, the support apparatuses can be employed for display purposes as, for example, in a store to display the work objects supported thereby for sale.

However, in the illustrative environment, it will be understood that the specific environment of use is the wall of a room, such as a bedroom, and wherein the work objects borne thereby are stored for frequent use and are conveniently accessible.

In the described environment of use, each of the support apparatuses can be adjusted to receive the particular work objects to be borne thereby. Such adjustment is achieved, as may best be visualized upon reference to FIGS. 4 and 5. The securing member 95 is shown in FIG. 4 in a secured, immovable and at rest position relative to the support assembly 60 on which it is mounted. This is because the support assembly is not tensioned longitudinally thereof and, therefore, the securing member constrictively engages the elastic linear members 80. This causes the securing member firmly to be retained in position, resisting displacement along the elastic linear members.

Figure 5:
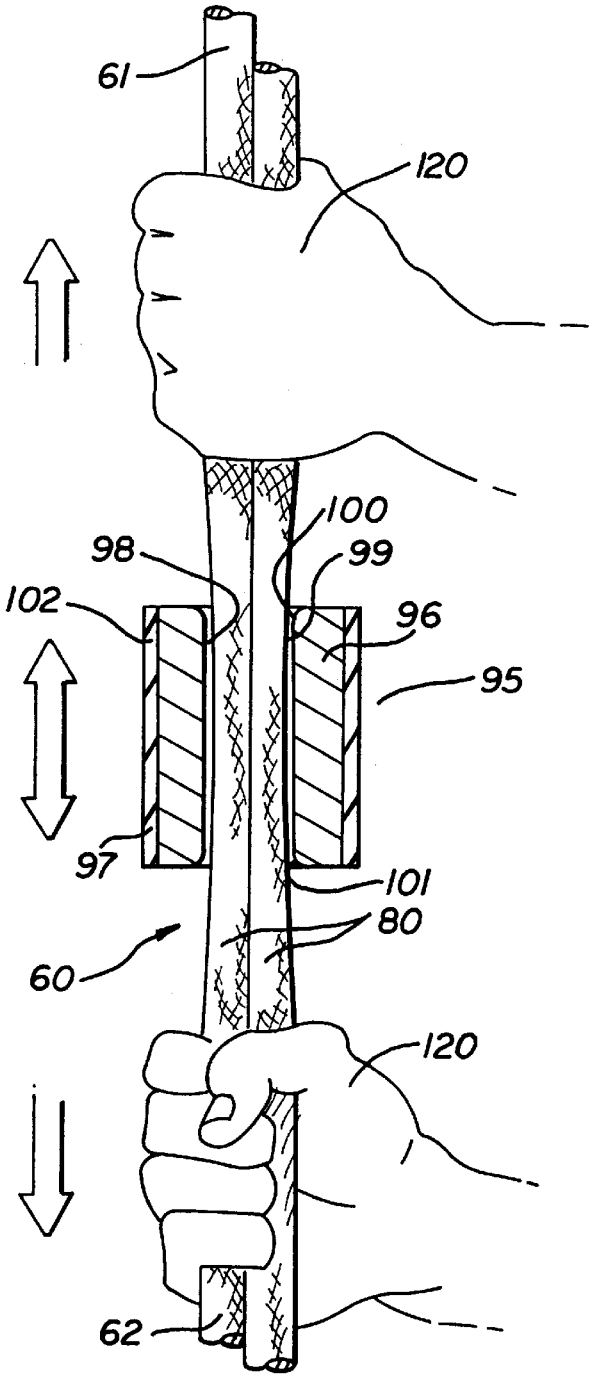
FIG. 5 is a longitudinal, vertical section corresponding to that of FIG. 4, but illustrating one manner in which the support apparatus can be adjusted to fit objects of different sizes, shapes and configurations.

As may be visualized upon reference to FIG. 5, repositioning of a securing member 95 along the elastic linear members 80 is achieved by tensioning the elastic linear members at the position of the securing member which is desired to be adjusted. This can be achieved by any desired means including in the manner depicted in FIG. 5 by pulling the elastic linear members, on opposite sides of the securing member desired to be adjusted, from each other. This causes the portion of the elastic linear members 80 within the securing member 95 to constrict transversely as they lengthen longitudinally which frees the securing member for slidable movement along the elastic linear members.

Alternatively, adjustment of the position of a given securing member 95 can be achieved simply by grasping the elastic linear members 80, on the opposite side of the securing member relative to the direction in which it is desired to move the securing member, and pulling the securing member in the desired direction away from the position of such grasping. Since the securing member constrictively engages the elastic linear members in its at rest position, movement of the securing member away from the stationary grasping position similarly causes the elastic linear members to constrict sufficiently to permit the securing member to be moved along the elastic linear members from the position of such grasping.

Using any of these methods for adjustment of the relative positions thereof, the securing members 95 are positioned so as to define an upper storage area 110, a central storage area 111 and a lower storage area 112 of the desired dimensions. The desired dimensions are determined by the sizes of the respective work objects to be received therein. The work objects are then simply individually inserted through the corresponding storage areas of the two support assemblies 60 so as to position them in the relative positions shown in FIG. 1. Each work object gravitationally assumes a position within its respective storage area resting against the securing members 95 of the support apparatuses 10 immediately therebeneath. The resistance of the securing members 95 on their respective elastic linear members 80 is sufficient to support the weight of each work object within its respective storage areas. The elastic linear members bounding each storage area retain the work object therewithin resiliently in the attitude in which it has been positioned within the storage areas. The weight of the work objects is supported by the mounting assemblies 50 on the wall 20. When it is desired to use any of the work objects, the work object is simply grasped and slidably removed from its respective storage areas of the support apparatuses. The other work objects continue to be retained in their respective storage areas freely available for use as desired while being retained in their respective supported positions and in clear view. The work objects are thereafter simply removed from, and returned to, their respective storage areas, as desired.

Since the storage areas of the support apparatuses 10 are fully repositionable, the work objects stored therein can be changed from time to time as desired and can be of varying type. For example, a surf board could be stored with snow skis and poles and a baseball bat, golf equipment and the like. Preferably, although not necessarily, each such work object is positioned in its own storage areas of the support apparatuses.

Depending upon the preferences of the user, the support apparatuses 10 can be supported in such a position on a wall as to be fully visible all of the time. Alternatively, since the support apparatuses bearing the work objects thereof are disposed in juxtaposition to the surface 21 of the wall 20, the support apparatuses and their respective work objects can be fully concealed, if desired, such as behind a piece of furniture, such as a dresser or other form of cabinetry, of sufficient size.

Therefore, the support apparatus of the present invention is capable of storing a diverse variety of work objects, such as personal possessions; is capable of adjusting to the particular work objects to be supported and stored; supports such work objects in a manner which makes them readily accessible for use while protecting them in a manner most conducive to ensuring long operational lives; permits such work objects to be stored in proximity to areas for use while being fully concealed and protected when desired; facilitates the ease by which the work objects can be inventoried; is of inexpensive construction permitting usage by virtually anyone desiring such a capability; and is otherwise fully effective in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for supporting a work object comprising a pair of deformable members and wherein said pair of deformable members possesses an elasticity permitting the pair to be deformed from a nondeformed configuration so as to be fitted about a work object and, when released, return toward the nondeformed configuration so as to grasp the work object with said area; means mounting said pair of deformable members substantially in side-by-side relation; and a securing member adapted to engage said pair of deformable members in spaced relation to said mounting means so as to capture a work object between the deformable members of said pair of deformable members and wherein said securing member is selectively movable along the pair of deformable members adjustably to capture said work object in an area bounded by the deformable members of said pair of deformable members, said mounting means and the securing member.

2. The apparatus of claim 1 wherein said pair of deformable members are longitudinally elastic whereby the pair of deformable members can be pulled from said mounting means to increase the length of said area between the mounting means and the securing member.

3. The apparatus of claim 1 wherein the pair of deformable members possesses an elasticity such that, when said pair of deformable members is pulled from the mounting means, they increase in length and decrease in diameter whereby the length of said area between the mounting means and the securing member is increased to receive said work object and the transverse dimension of the pair of deformable members is decreased to permit said securing member to be moved therealong toward the mounting means to capture the work object in said area and, upon release of the pair of deformable members, said pair of deformable members contract longitudinally to grasp the work object in said area and the transverse dimension of the pair of deformable member increases resiliently to capture the securing member thereon.

4. An apparatus for supporting a substantially flat work object in a stored position in substantially facing relation to an upright surface, such as a wall or the like, the appratus comprising:

A. a pair of elastic, substantially linear members which, under longitudinal tension, is disposed in a resiliently deformed condition elastically to increase in longitudinal dimension and to decrease in transverse dimension;

B. an assembly for mounting said pair of linear members on the upright surface in depending relation; and C. a securing member extending about said pair of linear members and, when the pair of linear members is in said deformed condition, is substantially slidable from the bounded by the pair of linear members, mounting assembly and securing member and, when released from said deformed condition, is substantially slidable toward the mounting assembly to capture the work object in said area in said stored position.

5. The apparatus of claim 4 wherein said securing member is a substantially rigid ring which is resiliently gripped in position extending about said pair of linear members when the pair of linear members is released from said deformed condition.

6. The apparatus of claim 4 wherein said mounting assembly includes a rigid support member adapted to be mounted on, and to extend outwardly from, said upright surface, an annular member adapted slidably to be received on said rigid member in supported relation thereon and wherein the pair of linear members is formed from a single elastic cord extending about the annular member and clamped thereon by a band to secure the elastic cord on the annular member and to form the pair of linear members of substantially equal lengths extending downwardly from said position in supported relation on the rigid member.

7. The apparatus of claim 6 herein said pair of linear members has a distal end portion which is bound and including a plurality of said securing members individually extended about the pair of linear members between said annular member and said distal end portion individually, substantially slidable therealong, when said pair of linear members is in said deformed condition, to define individually adjustable areas for the individual receipt of a plurality of work objects.

8. The apparatus of claim 7 in which two of said apparatuses are adapted to be mounted on said upright surface in laterally spaced relation to each other to define corresponding, laterally disposed, individually adjustable areas whereby said corresponding areas of said apparatuses are adapted to receive and support the same work objects in substantially facing relation to the upright surface extending in supported relation therebetween.

* * * * *